US012595971B2

(12) United States Patent
Martino González et al.

(10) Patent No.: US 12,595,971 B2
(45) Date of Patent: Apr. 7, 2026

(54) HEAT EXCHANGER

(71) Applicants: AIRBUS OPERATIONS, S.L.U., Madrid (ES); AIRBUS OPERATIONS LTD, Bristol (GB); AIRBUS DEFENCE AND SPACE GMBH, Taufkirchen (DE)

(72) Inventors: Esteban Martino González, Madrid (ES); Mario Linares Villegas, Madrid (ES); Lucía Bayona Revilla, Madrid (ES); Gareth Milbourn, Bristol (GB); David Jullien, Madrid (ES); Jorge Carretero Benignos, Taufkirchen (DE)

(73) Assignees: AIRBUS OPERATIONS, S.L.U., Madrid (ES); AIRBUS OPERATIONS LIMITED, Bristol (GB); AIRBUS DEFENCE AND SPACE GMBH, Taufkirchen (DE)

( * ) Notice: Subject to any disclaimer, the term of this patent is extended or adjusted under 35 U.S.C. 154(b) by 215 days.

(21) Appl. No.: 18/354,555

(22) Filed: Jul. 18, 2023

(65) Prior Publication Data

US 2024/0027136 A1 Jan. 25, 2024

(30) Foreign Application Priority Data

Jul. 19, 2022 (EP) ..... 22382694

(51) Int. Cl.
*F28D 15/02* (2006.01)
*F28D 15/04* (2006.01)
*F28D 21/00* (2006.01)

(52) U.S. Cl.
CPC ..... *F28D 15/0275* (2013.01); *F28D 15/0233* (2013.01); *F28D 15/04* (2013.01);
(Continued)

(58) Field of Classification Search
CPC ..... B33Y 80/00; F28D 15/02; F28D 15/0233; F28D 15/0275; F28D 15/04;
(Continued)

(56) References Cited

U.S. PATENT DOCUMENTS 5,975,841 A * 11/1999 Lindemuth ..... F01D 5/181 415/114
7,900,438 B2 * 3/2011 Venkataramani ... F28D 15/0275 244/134 B (Continued)

FOREIGN PATENT DOCUMENTS

EP 0268939 A1 6/1988

OTHER PUBLICATIONS

European Search Report for EP22382694 completed Dec. 13, 2022, 1 page.

*Primary Examiner* — Eric S Ruppert
*Assistant Examiner* — Hans R Weiland
(74) *Attorney, Agent, or Firm* — Nixon & Vanderhye P.C.

(57) ABSTRACT

A heat exchanger module including: a hollow chamber having an inner volume configured through which flows a first fluid in fluidic communication with a source of the first fluid, and a fluid outlet; a hollow enclosure extending outwardly from a surface of the hollow chamber wherein the hollow enclosure includes an inner volume through which flows a working fluid that undergoes a phase change in an operative mode of the heat exchanger module, wherein the hollow enclosure is in fluidic communication with a source of the working fluid, and an enclosure root of the hollow enclosure is inserted in the hollow chamber extending into the inner volume such that in an operative mode a working fluid flowing through the hollow chamber from the inlet to the outlet bathes the outer surface of the enclosure root.

20 Claims, 6 Drawing Sheets

(52) U.S. Cl.
CPC ..... *F28D 2021/0021* (2013.01); *F28D 2021/0061* (2013.01); *F28F 2215/00* (2013.01); *F28F 2250/02* (2013.01)

(58) Field of Classification Search
CPC ..... F28D 2021/0021; F28D 2021/0061; F28F 2250/02
See application file for complete search history.

(56) References Cited

U.S. PATENT DOCUMENTS

| | | | | |
|---|---|---|---|---|
| 8,616,834 | B2 * | 12/2013 | Knight, III | F01D 25/12 415/176 |
| 11,098,953 | B2 * | 8/2021 | Anderson | F28D 1/04 |
| 11,448,132 | B2 * | 9/2022 | Wiedenhoefer | F02C 7/185 |
| 2009/0169359 | A1 * | 7/2009 | Murphy | F02K 1/46 415/176 |
| 2012/0255708 | A1 * | 10/2012 | Wu | F28D 15/0266 165/67 |
| 2015/0027669 | A1 * | 1/2015 | Kokas | F28D 9/005 165/104.26 |
| 2016/0305279 | A1 * | 10/2016 | Gerstler | F01D 9/04 |
| 2017/0029126 | A1 | 2/2017 | Sarno et al. | |
| 2022/0381146 | A1 * | 12/2022 | Binek | F01D 5/181 |

* cited by examiner

HEAT EXCHANGER

RELATED APPLICATION

This application incorporates by reference and claims priority to European Patent application EP22382694.2, filed Jul. 19, 2022.

TECHNICAL FIELD

The present invention belongs to the field of heat exchangers. In particular, the invention refers to the use of working fluids undergoing a phase change during operation of the heat exchanger. The present invention also relates to methods for manufacturing heat exchangers which make use of working fluids undergoing a phase change during operation.

BACKGROUND OF THE INVENTION

Heat exchangers are devices used to force the exchange of energy, in the form of heat, between at least two thermal sources at different temperatures, typically two fluids. Conventional heat exchangers comprise an architecture designed to establish a thermodynamic communication between two fluids that can flow in parallel, countercurrent, or crosswise. Normally these fluids are confined within separated volumes to prevent their mixing, in such a way that the heat exchange is carried out through physical walls that separate the compartments where the fluids are contained.

Heat exchangers used in the field of the aeronautical industry typically are composed of hollow chambers in the shape of plates or pipes, and fins. A first fluid flows inside the plates or pipes whereas the second fluid flows outside these plates or pipes, bathing their external surface. Part of the heat is directly transferred from one fluid to the other fluid though the plates or pipes walls, called primary walls. Additionally, secondary walls called fins can be present, arranged in contact with the primary walls and the second fluid, enabling additional contact surface between said second fluid and the primary walls, allowing increased heat transfer from that second fluid.

Thus, a first fluid, generally in the liquid phase, flows continuously inside the pipes or plates, while a second fluid flows continuously outside in contact with the primary walls (generally metallic), that separate both fluids, thus forcing convection. Additional secondary walls or fins (also generally metallic) can be present inside the pipes or plates, in contact just with the first fluid inside the pipes or plates. The heat is transmitted from the fluid at a higher temperature to said primary walls and metallic fins and is evacuated by the continuous flow of the fluid at a lower temperature.

SUMMARY

In a first inventive aspect, the invention provides a heat exchanger module comprising: at least one hollow chamber comprising an inner volume configured to contain a fluid, said hollow chamber further comprising a fluid inlet and a fluid outlet, wherein the fluid inlet of the hollow chamber is configured to be in fluidic communication with a source of a first fluid, at least one hollow enclosure extending outwardly from a surface of the hollow chamber, said hollow enclosure comprising an inner volume housing a working fluid, wherein said working fluid is configured to undergo a phase change in an operative mode of the heat exchanger module, wherein the hollow enclosure is configured to be in fluidic communication with a source of a second fluid, and wherein an enclosure root of said hollow enclosure is inserted in the hollow chamber, extending into the inner volume of said hollow chamber, such that in an operative mode a fluid flowing through the hollow chamber from the fluid inlet to the fluid outlet bathes the outer surface of said enclosure root.

A hot fluid is a fluid to be cooled by extracting heat from the hot fluid in a heat-exchanger using a cold fluid. Heat energy is evacuated from the cold fluid and transferred to the hot fluid. For the functioning of a heat exchanger module, a hot fluid is warmer than the cold fluid.

To illustrate the operation of the heat exchanger module in relation to its features, as described below, the heat exchanger module may have two circuits each for the flow there through. A first fluid, e.g., the hot fluid, flows through the first circuit and a second fluid, e.g., the cold fluid, flow through the second circuit. The first and second fluids exchange thermal energy during operation of the heat exchanger module. In this regard, two embodiments of different operative modes of the heat exchanger module are described below.

First, for the provision of a first fluid, the hollow chamber comprises a fluid inlet configured to be in fluidic communication with a source of fluid, and a fluid outlet. A first circuit for the first fluid is thus defined. In an embodiment, the fluid outlet may be in fluidic connection with the fluid inlet, defining a closed circuit comprising a fluid pump. In particular embodiments of the closed circuit, the fluid pump may comprise at least a pump for the case where the first fluid is in liquid phase, or a compressor for the case where the first fluid is in vapor or gas phase.

In order to carry out the heat-exchanging operation, a second circuit is defined, wherein a source provides a second fluid. In particular, this second fluid is provided, in an operative mode of the heat exchanger module, bathing the hollow enclosures of the heat exchanger module, in order to force convection.

The choice between an operative mode wherein the first fluid is hot and the second fluid is cold, or an operative mode wherein the first fluid is cold and the second fluid is hot depends on the heat-exchanging operation to be carried out by the heat exchanger module. In this regard, two embodiments of different operative modes of the heat exchanger module are described below.

In a first embodiment of an operative mode, a hot first fluid, preferably in liquid phase, flows through the hollow chamber, transmitting thermal energy in the form of heat to the hollow enclosures at least through the portion of said hollow enclosures that is inserted in the hollow chamber. With respect to such portion of the hollow enclosure inserted into the hollow chamber, it will also be referred to throughout the text by the term 'enclosure root'.

Additionally, the junction between the hollow chamber and the hollow enclosure is mechanically continuous and completely sealed to avoid any leakage of the first fluid out of the hollow chamber or of the second fluid into the hollow chamber. Therefore, there is also an energy transmission by conduction between the respective walls of the hollow chamber and the hollow enclosure in contact.

A cold second fluid flows, bathing the hollow enclosures, forcing convection and evacuating part of the heat that said hollow enclosures receive from the first fluid.

According to the second embodiment of an operative mode of the heat exchanger module, the second fluid that flows bathing the lateral surfaces of the hollow enclosures in a hot fluid, transmitting part of its thermal energy to the hollow enclosures. The first fluid, which flows through the hollow chamber, is a cold fluid, preferably in liquid phase, which is responsible for evacuating the heat absorbed by the enclosures through the area in contact with them, that is, the enclosure root.

At least one hollow enclosure functions, during operation, according to the principles of a heat pipe. Heat pipes are passive two-phase heat transfer systems which, by virtue of a phase change of a fixed amount of working fluid stored within the heat pipe, provide an enhanced heat transfer compared to single-phase systems. In particular, heat pipes transport heat from one point (heat source) to another (heat sink) with extremely high thermal conductance due to the latent heat of vaporization of said working fluid. In this regard, the hollow enclosure comprises a closed inner volume housing a working fluid configured to undergo a phase change during operation of the heat exchanger module. During operation of the heat exchanger module, the working fluid contained within the inner volume of the hollow enclosure undergoes a phase-change, from liquid phase to vapor phase, due to the thermal energy provided by the hot fluid. The vapor phase condenses back to a liquid phase and releases latent heat. The thermal energy released by the condensation of the working fluid is then transferred to the cold fluid.

Afterwards, the condensed liquid phase of the working fluid is conducted from a heat sink part of the hollow plate, that is, the part of the hollow enclosure exposed to the circulation of the cold fluid to the heat source, that is, the part of the hollow enclosure exposed to the circulation of the hot fluid.

In an embodiment, the liquid phase of the working fluid returns to the part of the hollow enclosure exposed to the circulation of the hot fluid for subsequent evaporation by the action of gravity and/or a centrifugal force exerted on the heat exchanger module.

Working fluids are chosen according to the temperatures at which the heat exchanger module must operate, with examples ranging from liquid helium for extremely low temperature applications (2 to 4 degrees Kelvin (K)) to mercury (523 923 degrees K), sodium (873 to 1473 degrees K), ammonia (213 to 373 degrees K), alcohol such as methanol (283 to 403 degrees K) and ethanol (273 to 403 degrees K), water (298 to 573 degrees K) and indium (2000 to 3000 degrees K) for extremely high temperatures.

An embodiment of the heat exchanger module of the invention includes at least one hollow enclosure providing a passage for a working fluid configured to undergo phase changes, permits releasing latent heat during the heat-exchanging operation and increases effective thermal conductivity as compared to heat exchangers with solid enclosures and/or solid fins.

This improvement of the effective thermal conductivity allows for an increase in the separation between the hollow enclosures in the heat exchanger as compared to the separation between solid fins in an example of a conventional heat exchanger. The increased separation may result in a pressure drop along the area of the heat exchanger exposed to forced convection by the circulation of the second fluid and may result in a reduction of elements exposed to the incident second fluid. Similarly, the height of the hollow enclosures may be increased to further reduce the heat exchanger modules/components needed to dissipate a given amount of heat as compared to classic configuration of a conventional heat exchanger comprising a plurality of solid fins.

Additionally, in embodiments of heat exchanger modules comprising a plurality of hollow enclosures, such as the free space, e.g., channels, defined widthwise between successive hollow enclosures, and height wise between a hollow chamber and a distal end of a hollow enclosure opposite the hollow chamber), through which the second fluid travels, is increased.

This reduction of elements also results in a reduction of weight of the heat exchanger module compared to a heat exchanger of equivalent heat exchange power with a conventional configuration comprising fins or solid plates as elements for exchanging heat between two fluids, and where there is no working fluid undergoing a phase change that allows an additional amount of heat to be evacuated.

Regarding possible geometries for the hollow enclosure, different embodiments of the invention encompass one or more of the following configurations: a substantially flat plate; a substantially curved plate, the side surfaces of which being parallel to each other; a plate with a corrugated or undulating profile on at least one of its faces; a substantially cylindrical structure; and/or a piping structure having a cross-section comprising an airfoil geometry.

Embodiments of hollow enclosures comprising curved surfaces, may adapt better to the flow of the second fluid in order to increase the heat transfer area per volume and, as a consequence, increase the heat transfer.

In an embodiment, at least one hollow enclosure comprises a wick structure provided on at least a portion of the inner surface of the hollow enclosure.

A wick structure should be understood as a capillary structure which allows a condensed liquid phase of the working fluid to move against the vapor flow by the capillary action.

In this embodiment, the condensed liquid phase is conducted from the part of the hollow enclosure exposed to the circulation of the cold fluid to the heat source by capillarity in the wick structure. In particular, condensed working fluid saturates the wick structure and creates capillary pressure, the liquid thus being conducted back to the part of the hollow enclosure exposed to heat where it evaporates and thus also creates a suction of the liquid fluid.

The wick structure further contributes to keep the liquid phase of the working fluid evenly distributed. Wick structures can be classified as either homogeneous wicks or composite wicks. Homogeneous wicks are composed of a single material and configuration. Composite wicks are composed of two or more materials and configurations.

In an embodiment, the wick structure provided on at least a portion of the inner surface of the hollow enclosure comprises at least one of the following structural elements: sintered metal powder, screen mesh, screen-covered groove, screen slab with grooves, and screen tunnel with grooves.

Additional embodiments of wick structures may be generated by increasing the roughness or relief of the surface (i.e., at least a portion of the inner surface of the hollow enclosure) or by providing said surface with porosity.

Preferably, the properties of the material used for manufacturing the wick structures has a high thermal conductivity, high wick porosity, small capillary radius, and high wick permeability.

In an embodiment, the heat exchanger module comprises a plurality of hollow enclosures spaced from each other and arranged such that a channel is defined between consecutive hollow enclosures. In an embodiment, the hollow enclosures are arranged substantially parallel to each other.

In an embodiment, at least one channel comprises a plurality of fins provided between consecutive hollow enclosures.

Said fins define a plurality of sub-channels along each channel.

In an embodiment, a plurality of fins are attached by their respective side edges to two consecutive hollow enclosures, wherein, in each channel, the fins are spaced from and arranged substantially parallel to each other.

The fins, arranged between consecutive hollow enclosures, in addition to serving as a structural bridge, mechanically connecting those hollow enclosures, provide additional contact surface with the second fluid to transfer thermal energy, and also serve to transfer thermal energy between the hollow enclosures themselves.

In an embodiment, a plurality of fins is arranged between consecutive hollow enclosures according to a honeycomb pattern.

In an embodiment, the fins are shaped with an undulating profile.

In addition to the provision of the fins which divide the channels into a plurality of sub-channels, the undulating geometry of said fins advantageously allows to regard said sub-channels as corrugated tubes which contribute to improving the heat-exchanging operation by optimizing the heat exchange surface with the cold/hot fluid for a given distance between two hollow enclosures to which said fin is connected.

In particular, the heat-exchanging operation is improved by the capability of said corrugations or undulations of the fins to originate three heat transfer mechanisms such as secondary flow formation, development of boundary layer and intensifying turbulent intensity of the flow.

With respect to said turbulent flow, the main difference compared to laminar flow, as far as heat transfer is concerned, is the generation of convection flows in the radial and azimuthal directions, which provides much better transfer of energy across the flow by providing a mixing of the flow. In laminar flow, conduction is typically the only mechanism that operates in the transverse directions between different streaming lines of the flow.

In an embodiment, the enclosure root is shaped as an aerodynamic profile, preferably a NACA airfoil, arranged with the leading edge oriented towards the inlet of the hollow chamber for diverting an incident flow of fluid during an operative mode of the heat exchanger module.

In one embodiment where the direction of the flow of the first fluid along the hollow chamber, and the direction of the flow of the second fluid are crossed, the chord of aerodynamic profile of the enclosure root is disposed with the leading edge configured to face the incident stream of first fluid, and the main direction of the hollow enclosure is disposed configured to be oriented substantially parallel to the incident stream of second fluid.

In this way, the pressure drop for both the first fluid inside the hollow chamber and the second fluid in contact with the hollow enclosure is minimized.

In a more particular embodiment, in which said crossed-flows flow perpendicularly, the chord of the aerodynamic profile of the enclosure root, and the main direction of the hollow enclosure exposed to the incident stream of second fluid, are perpendicular.

Advantageously, pressure drop of the fluid flowing through the hollow chamber, resulting from encountering the portions of hollow enclosure in its way, is limited.

In an embodiment, the at least one hollow enclosure is arranged extending substantially perpendicularly from a surface of the hollow chamber.

In an embodiment, the heat exchanger module comprises a working fluid distribution circuit comprising an inlet configured to be in fluidic communication with a source of working fluid, a pipe connected to the inlet and to the inlet of a hollow enclosure. In an embodiment, the heat exchanger module comprises a plurality of hollow enclosures and the pipe is divided into a plurality of branches, each of the branches being connected to a corresponding inlet of a hollow enclosure.

In an embodiment, the pipe comprises fluid regulating means arranged between the inlet and connection nodes of the pipe from which the different branches extend.

In an embodiment, the flow regulating means comprises a valve and/or a nut configured to close a section of the pipe and prevent flow of working fluid through the pipe.

In an embodiment, the inner volume of a hollow enclosure is divided into a plurality of different compartments, each compartment being adapted to receive working fluid; wherein the hollow enclosure comprises a plurality of enclosure roots; and wherein each compartment is in fluid communication with a different enclosure root.

In an embodiment, the inner volume defined within at least one hollow enclosure is shaped comprising a plurality of ducts separated from each other, said ducts branching from the enclosure root.

In a more particular embodiment wherein the inner volume of a hollow enclosure is divided into a plurality of different compartments adapted to receive working fluid, each compartment is shaped comprising a plurality of ducts separated from each other, said ducts branching from each corresponding enclosure root.

In a second inventive aspect, the invention provides a method for manufacturing a heat exchanger module according to an embodiment of the first inventive aspect, using an additive manufacturing technique, the method comprising the steps of: providing a bed of powdered material, forming a plurality of layers by fusing together at least a portion of the powdered material provided, obtaining as a result a hollow enclosure comprising an inner volume and a hollow chamber, and confining the working fluid within the inner volume of the hollow enclosure during the manufacturing process, layer by layer, of said hollow enclosure, such that the working fluid is contained within the inner volume after the hollow enclosure consolidates.

Additive Manufacturing (AM) techniques have the advantage of being able to include integrated cavities with complex shapes assuring minimum fin sliminess and thickness, directly into the built process of the heat exchanger. Additive manufacturing techniques also allow to obtain optimal geometries as complex as necessary for maximizing the heat transfer.

Advantageously, by virtue of the sequential manufacturing and precision offered by additive manufacturing techniques, it is possible to manufacture the wick structures, which require very small structures and sometimes very complex structures, directly into the manufacturing process of the hollow enclosure. Otherwise, using other manufacturing methods, said wick structures could not be implemented without subsequent machining operations that could jeopardize the structural integrity of the hollow enclosure.

In an embodiment, the working fluid is provided, according to the method of the invention, by carrying out the additive manufacturing process in a controlled atmosphere comprising working fluid in gaseous phase. In other embodiments, the additive manufacturing process carried out for manufacturing the heat exchanger module may comprise supplying the working fluid, in liquid or gaseous phase, by means of a nozzle forming part of the equipment used for consolidating the powdered material layer by layer.

In an embodiment, the bed of powdered material comprises, preferably, copper, titanium, Inconel, steel, aluminum and/or other metallic material, as well as ceramic materials or a combination of them.

In a preferred embodiment, Powder bed fusion ALM process (PBF), also known as electron beam melting (EBM) is used for manufacturing a heat exchanger module according to the invention.

The powder is selectively fused together using a laser or electron beam. Once a layer of material is fused, the working area moves down, and the new layer is built on top of the previous layer using the same process.

Other known additive manufacturing techniques that are considered in the context of the invention as possible options to manufacture a heat exchanger module or any of its components are: Directed Energy Deposition (DED); Binder Jetting; Material Jetting; Vat Polymerization; Material Extrusion; and Sheet Lamination.

In an embodiment, the hollow chamber is manufactured integrally with a working fluid distribution circuit, the working fluid distribution circuit comprising a pipe, divided into a plurality of branches.

In an embodiment, the hollow enclosure is manufactured integrally with a plurality of ducts shaped within, the plurality of ducts being manufactured with a wick structure on at least a portion of their surface.

In a third inventive aspect, the invention provides a heat exchanger comprising at least a first and a second heat exchanger modules according to an embodiment of the first inventive aspect, wherein said first and second heat exchanger modules are coupled to each other by means of corresponding distal ends opposite the enclosure roots of the at least one hollow enclosure of the first and second heat exchanger modules, respectively.

In a fourth inventive aspect, the invention provides an aircraft comprising at least a heat exchanger module according to an embodiment of the first inventive aspect, wherein at least the distal end of at least one hollow enclosure is inserted in an outer skin of the aircraft.

In an embodiment, the outer skin where the distal end of at least one hollow enclosure is inserted belongs to one of the following: the wing; the empennage; or the nacelle.

In an embodiment, at least a heat exchanger module is configured to be in fluidic communication with a source of air bled from the bypass stream flowing through the engine fan duct of the aircraft.

DESCRIPTION OF THE DRAWINGS

These and other characteristics and advantages of the invention will become clearly understood in view of the detailed description of the invention which becomes apparent from preferred embodiments of the invention, given just as examples and not being limited thereto, with reference to the drawings.

DETAILED DESCRIPTION

Figure 1:
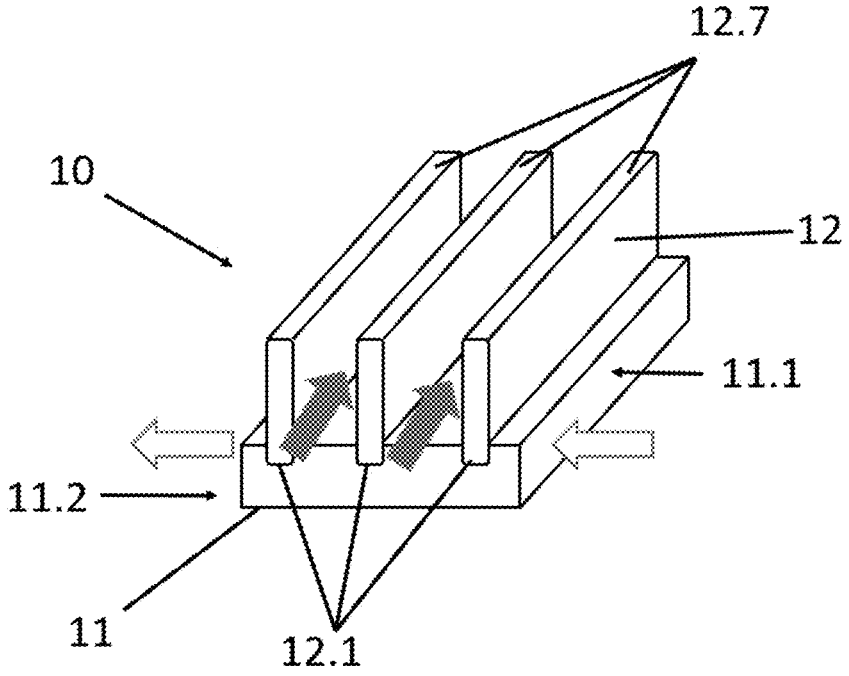
FIG. 1 shows a schematic representation of a heat exchanger module according to an embodiment of the present invention.

FIG. 1 shows a schematic representation of a heat exchanger module according to an embodiment of the present invention.

The first heat exchanger module (10) comprises a hollow chamber (11) comprising an inner volume defined within and configured to contain a first fluid, so that in an operative mode of the first heat exchanger module (10), a flow of hot/cold first fluid flows through the hollow chamber (11) for being cooled/evacuating heat, respectively by the heat-exchanging operation carried out by the first heat exchanger module (10). In this embodiment, the hollow chamber (11) is shaped as a rectangular prism, but other shapes are possible for the hollow chamber (11).

As will be described, the choice between hot or cold fluids will depend on the heat-exchanging operation to be carried out. In the context of the present invention, a 'hot' fluid should be regarded as a fluid intended to be cooled by extracting heat from the hot fluid in the heat-exchanging operation from another fluid is the 'cold' fluid. The cold fluid will evacuate heat energy from the hot fluid.

In one mode of operation, the first fluid flowing through a hollow chamber (11) may be a hot fluid intended to be cooled, or it may be a cold fluid intended to be used as a coolant for a second fluid.

For the provision of the flow the first fluid, the hollow chamber (11) comprises a fluid inlet (11.1) configured to be in fluidic communication with a source of the first fluid. The hollow chamber (11) has a fluid outlet (11.2) configured to extract the first fluid from the first heat exchanger module (10). The direction of advance (flow) of the flow of first fluid is schematically depicted in FIG. 1 with white unfilled arrows (horizontal). These arrows also schematically depict the first fluid.

In this embodiment, the first heat exchanger module (10) also includes three hollow enclosures (12) extending perpendicularly from a surface of the hollow chamber (11). The hollow enclosures are spaced from each other and are substantially parallel to each other, e.g., within 5 degrees of parallel. Channels are defined between consecutive ones of the hollow enclosures (12) of the first heat exchanger module (10). In other embodiments, the number of hollow enclosures may be less or more than the three shown in FIG. 1.

Each hollow enclosure (12) comprises an inner volume housing a working fluid, wherein said working fluid is configured to undergo a phase change in an operative mode of the first heat exchanger module (10).

A portion (12.1) of the hollow enclosures (12) is inserted in the hollow chamber (11), extending into the inner volume of said hollow chamber (11), such that in an operative mode a first fluid flowing through the hollow chamber (11) from the inlet (11.1) to the outlet (11.2) bathes the outer surface of said portion (12.1) of the hollow enclosures (12). Said portion (12.1) of the hollow enclosures (12) is referred to herein as enclosure root (12.1).

As can be seen, each hollow enclosure (12) of the heat exchanger module (10) is provided with a distal end (12.7) opposite the enclosure root (12.1).

In in an operative mode, in order to carry out the heat-exchanging operation, a source provides a second fluid.

In the particular embodiment shown, this second fluid is provided as a flow of gas passing through the channels defined between consecutive hollow enclosures (12), forcing convection with the lateral surfaces of said hollow enclosures (12). As can be seen in FIG. 1, the direction of advance of the flow of gas (second fluid) is represented with grey colored arrows (pointed into the figure). These arrows also depict the gas (second fluid).

In the particular embodiment of FIG. 1, the hollow enclosures (12) are arranged parallel to each other, forming conduits for the flow of gas.

The hollow enclosures (12) function, during operation, according to the principles of a heat pipe. In particular, each hollow enclosure (12) comprises an inner volume housing a working fluid which undergoes two phase changes during operation of the heat exchanger module (10). In particular, the fluid undergoes a phase change cycle in which part of the fluid in the liquid state is vaporized while with part of the fluid in the gaseous state is condensed.

With respect to the working fluid used in an embodiment such as the one depicted in FIG. 1, may be one of the following: ammonia, alcohol, ethanol or water.

In one example of operation of the embodiment shown in FIG. 1, a hot first fluid intended to be cooled circulates through the hollow chamber (11) of the heat exchanger module (10). Said first fluid transmits part of the stored energy in the form of heat to the working fluid contained within the hollow enclosures (12) through the outer surface of the enclosure root (12.1). As a result, the working fluid evaporates and expands through the inner volume of the hollow enclosures (12).

A second fluid, which in the embodiment considered is a flow of cold gas, and whose direction of advance is represented with grey colored arrows, passes through the channels defined between consecutive hollow enclosures (12), bathing the lateral surfaces of said hollow enclosures (12).

Convection forced by the flow of cold gas evacuates part of the thermal energy. Therefore, the working fluid within the hollow enclosures (12) condenses back into a liquid phase, releasing the latent heat, and returns to the enclosure roots (12.1), where the liquid working fluid is exposed again to the heat of the first fluid flowing through the hollow chamber (11), the heat evacuating cycle being maintained thereby.

In the embodiment of FIG. 1, the liquid phase of the working fluid returns to the enclosure roots (12.1) by the action of capillary forces. More in particular, in order to generate the capillary forces, the hollow enclosures (12) of the embodiment shown in FIG. 1 comprise a wick structure provided on at least a portion of the surface of the inner volume defined within said hollow enclosures (12).

Examples of wick structures which can be used within the scope of the present invention comprise at least one of the following structural elements: sintered metal powder, screen mesh, and/or grooves. Additionally wick structures can be generated by increasing the roughness or relief of the surface.

In other embodiments, the liquid phase of the working fluid returns to the hot interface of the hollow enclosures (12) for subsequent evaporation by other means, such as, for example, by the action of gravity and/or a centrifugal force.

Figure 2:
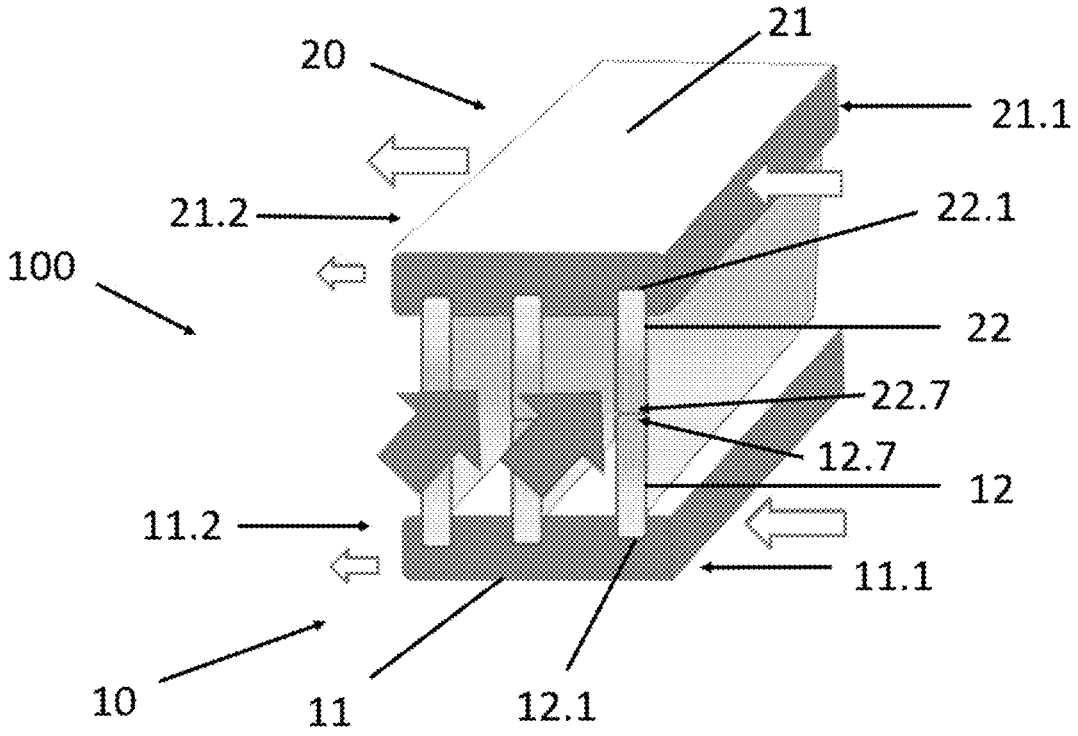
FIG. 2 shows a schematic representation of a heat exchanger comprising two heat exchangers modules coupled to each other according to an embodiment of the present invention.

FIG. 2 shows a schematic representation of an embodiment of a heat exchanger comprising two heat exchanger modules (10, 20) coupled to each other. In this embodiment, each heat exchanger module (10, 20) is according to the embodiment described in connection with FIG. 1.

As can be seen, each hollow enclosure (12) of the first heat exchanger module (10) is arranged with a distal end (12.7) mechanically coupled to a respective distal end (22.7) of an opposite hollow enclosure (22) extending outwardly from the hollow chamber (12) of the second heat exchanger module (20).

Structural continuity between the first (10) and second (20) heat exchanger modules is thus provided through the interface between the connected hollow enclosures (12, 22). Accordingly, channels are defined between consecutive pairs of coupled hollow enclosures (12.7, 22.7) and the opposite hollow chambers (11, 21).

In other embodiments, a plurality of the hollow enclosures (12) can be staggered with respect to each other, so that the distal ends (12.7) of the first (10) and second (20) heat exchanger modules are not coincident so that they cannot be mechanically coupled. In this case, additional structural elements between the first and second heat exchanger modules (10, 20) are required. The staggered position of the hollow enclosures (12) from the two modules (10, 20) can allow a higher lateral surface of the hollow enclosures (12, 22) in contact with the second fluid and higher heat transfer.

As described in connection with FIG. 1, in an operative mode of the heat exchanger (11) a second fluid is necessary to provide/evacuate thermal energy in each of the first heat exchanger module (10) and second heat exchanger module (10).

In particular, this second fluid is provided as a flow of gas passing through the channels defined between consecutive hollow enclosures (12, 22), forcing convection with the lateral surfaces of said hollow enclosures (12, 22). As can be seen in FIG. 2, the direction of advance of the flow of gas is represented with grey coloured arrows.

In the particular embodiment of FIG. 2, the hollow enclosures (12, 22) are arranged parallel to each other.

As mentioned, the hollow enclosures (12, 22) function, during operation, according to the principles of a heat pipe. In particular, each hollow enclosure (12, 22) comprises an inner volume housing a working fluid which undergoes a phase change during operation of the heat exchanger (100), that is, during operation of each of the first (10) and second (20) heat exchanger modules.

In one example of operation of the embodiment of the heat exchanger (100) shown in FIG. 2, a hot first fluid intended to be cooled circulates through the hollow chambers (11, 21) of each heat exchanger module (10, 20). Said first fluid transmits part of its thermal energy to the working fluid contained within the hollow enclosures (12, 22) through the outer surface of the enclosure roots (12.1, 22.1). As a result, the working fluid evaporates and expands through the inner volume of the hollow enclosures (12, 22).

A second fluid, which in the embodiment considered is a flow of cold gas, and whose direction of advance is represented with grey colored arrows, passes through the channels defined between consecutive hollow enclosures (12, 22), bathing the lateral surfaces of said hollow enclosures (12, 22). The cold gas is heated by radiation and convection along the hollow enclosures (12, 22), thereby cooling down the working fluid in the hollow enclosures.

In the particular embodiment shown in FIG. 2, the first and second fluids, that is, the cold fluid and the hot fluid, are flowing in perpendicular directions as showed by the grey and white arrows, respectively. This configuration with perpendicular flows is called cross flow. On additional embodiments these flows can be parallel, flowing in the same direction or in opposite direction. The latest configuration is called counter flow. Normally, the efficiency is increased with counter flow configurations.

The hollow enclosures (12, 22) can be provided with a combination of shapes adapted to reduce the pressure drop and increase the heat transmission in relation to the first or second fluid with which they are in contact in an operative mode. That is, the enclosure root (12.1) can have a shape adapted to reduce the pressure drop of the first fluid flowing in the hollow chambers (11, 21). In turn, the outer surface of the hollow enclosure (12) can have a shape adapted to reduce the pressure drop of the second fluid.

In one embodiment where the direction of the flow of the first fluid along the hollow chamber (11, 21) and the direction of the flow of the second fluid are crossed, the geometry of the enclosure root (12.1) is profiled towards the incident stream flowing through the hollow chamber (11, 21), while the geometry of the hollow enclosure body exposed to the incident flow of the second fluid tends to be profiled towards such incident flow, everything while maintaining tightness to avoid any leakage of the first fluid out of the hollow chamber (11, 21) or of the second fluid into the hollow chamber (11, 21).

Convection forced by the flow of cold gas evacuates part of the thermal energy. Therefore, the working fluid within the first and second hollow enclosures (12, 22) condenses back into a liquid phase, releasing its latent heat, and returns to the enclosure roots (12.1, 21.1), where the liquid working fluid is exposed again to the heat of the fluid flowing in the hollow chambers (11, 21), the heat evacuating cycle being maintained thereby.

As mentioned in connection with FIG. 1, in this embodiment the liquid phase of the working fluid returns to the enclosure roots (12.1, 21.1) by the action of capillary forces generated by the wick structure provided on at least a portion of the surface of the inner volume defined within said hollow enclosures (12, 22).

Figure 3:
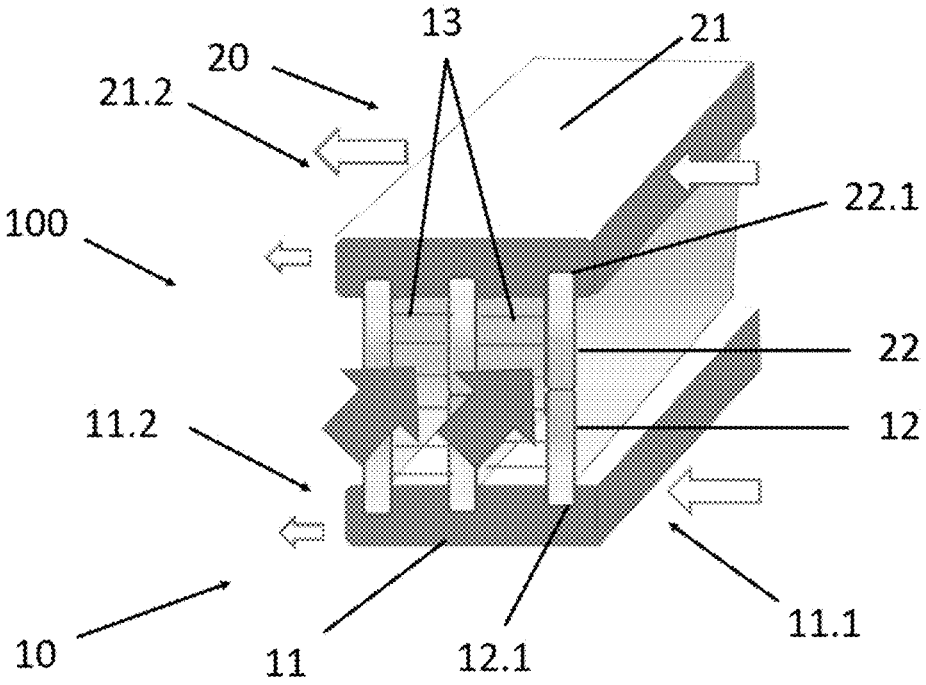
FIG. 3 shows a schematic representation of a heat exchanger comprising two heat exchanger modules coupled to each other, with a plurality of fins provided between consecutive hollow enclosures, according to an embodiment of the present invention.

FIG. 3 shows a schematic representation of the very same heat exchanger (100) shown in FIG. 2, but further comprising a plurality of fins (13) provided in the channels defined between consecutive pairs of coupled hollow enclosures (12.7, 22.7) and the opposite hollow chambers (11, 21).

In particular, as can be seen, the plurality of fins (13) are attached by their respective side edges to two consecutive hollow enclosures (12, 22), and are spaced from and arranged substantially parallel to each other.

The fins (13) define a plurality of sub-channels along each channel. In an embodiment, said fins (13) are shaped with an undulating geometry. Advantageously, said undulating geometry allows to regard said sub-channels as corrugated tubes which contribute to improving the heat-exchanging operation.

Regarding said undulating geometry of the fins (13), smaller wavelengths promote local turbulent flow on the boundary layer, in turn promoting the boundary layer mixing and increase of heat transfer.

Figure 4:
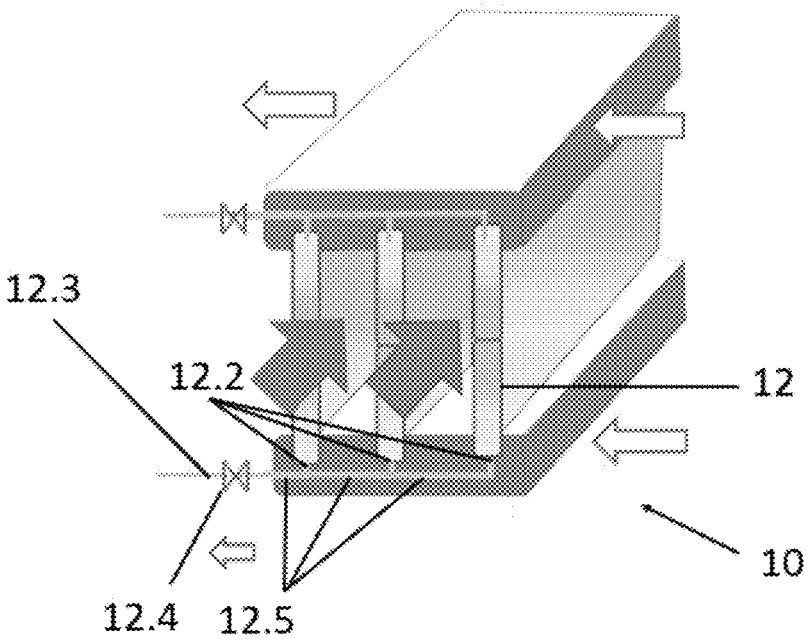
FIG. 4 shows a schematic representation of a heat exchanger comprising two heat exchanger modules coupled to each other according to an embodiment of the present invention, with a working fluid distribution circuit connected to the hollow enclosures of a heat exchanger module, according to an embodiment of the present invention.

FIG. 4 shows a schematic representation of the very same heat exchanger (100) shown in FIG. 2, but further comprising a working fluid distribution circuit connected to the hollow enclosures (12) of the first (10) and second heat exchanger modules. More in particular, for illustrative purposes, reference numbers are provided only in relation to the working fluid distribution circuit connected to the first (10) heat exchanger module of the heat exchanger shown in FIG. 4. That is, the heat exchanger module (10) provided at the lowermost part.

As can be seen, each of the three hollow enclosures (12) shown in FIG. 4 comprises an inlet (12.2) connected to the working fluid distribution circuit. In particular, said fluid distribution circuit establishes a fluidic communication between a source of working fluid and the inner volume of the hollow enclosures (12), thus performing the function of recharging or extracting the working fluid from inside the hollow enclosures (12).

The working fluid distribution circuit shown comprises a main pipe (12.3) that includes flow regulator (12.4), such as an air nipple valve, downstream of which the pipe (12.3) branches into a plurality of branches (12.5) in fluidic communication with the hollow enclosures (12). The working fluid is housed in the working fluid distribution circuit and may flow continuously through the circuit or may remain in the branches (12.5) of the circuit until refilled from a source of the working fluid and/or vented from the circuit.

For illustrative purposes, only an inlet (12.2) connection for each hollow enclosure (12), and only a single valve (12.4) in the working fluid distribution circuit are represented, but it shall be understood that in further embodiments of the invention, additional connections (12.2) functioning as an additional inlet or outlet and valves (12.4) for each connection could be added to ease the recharging and extracting of the working fluid into and from the hollow enclosures (12).

In the case of additive manufacturing of the heat exchanger modules through powder bed fusion, this working distribution circuit can be also used to remove the powder that is captured into the hollow enclosures during the manufacturing process.

Figure 5:
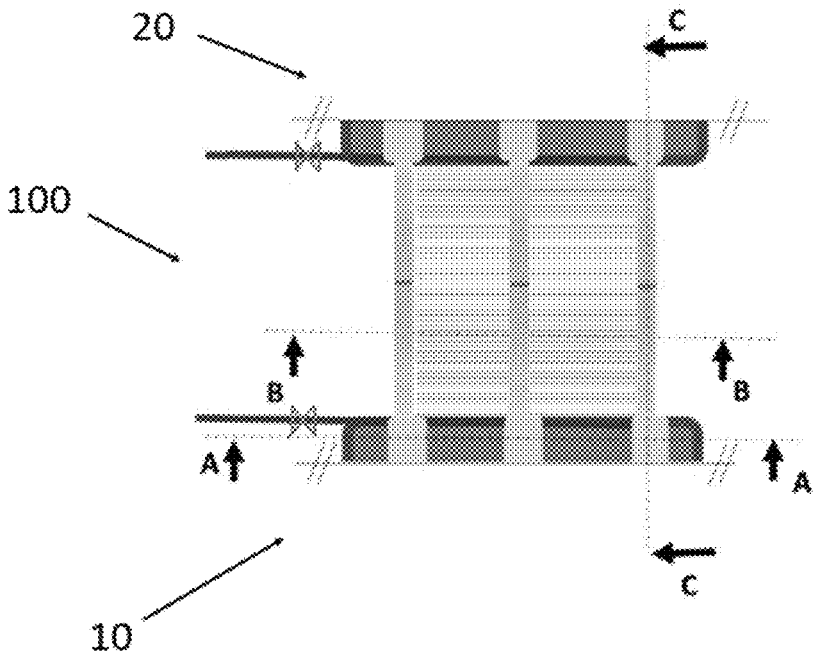
FIG. 5 shows a schematic representation of a front view of a heat exchanger according to an embodiment of the present invention.

FIG. 5 shows a schematic representation of a cross-section of a heat exchanger (100) comprising a first (10) and a second (20) heat exchanger modules (10, 20) coupled to each other in the very same manner of the embodiments shown in FIGS. 2-4.

More in particular, FIG. 5 provides a view of a heat exchanger (100) showing three dashed straight lines which represent three intersecting planes AA, BB, CC, which are described in greater detail in relation to the following FIGS. **6*a*-6*c***.

Planes, AA, BB and CC, correspond respectively to:

a horizontal plane intersecting the hollow chamber of the first (10) heat exchanger module;

a horizontal plane intersecting the three hollow enclosures of the first (10) heat exchanger module; and a vertical plane intersecting two connected hollow enclosures (12, 22) along their entire length, from end to end, that is, from the enclosure root of a hollow enclosure (12) to the respective enclosure root (12.1) of the opposite hollow enclosure (12).

Figure 6A:
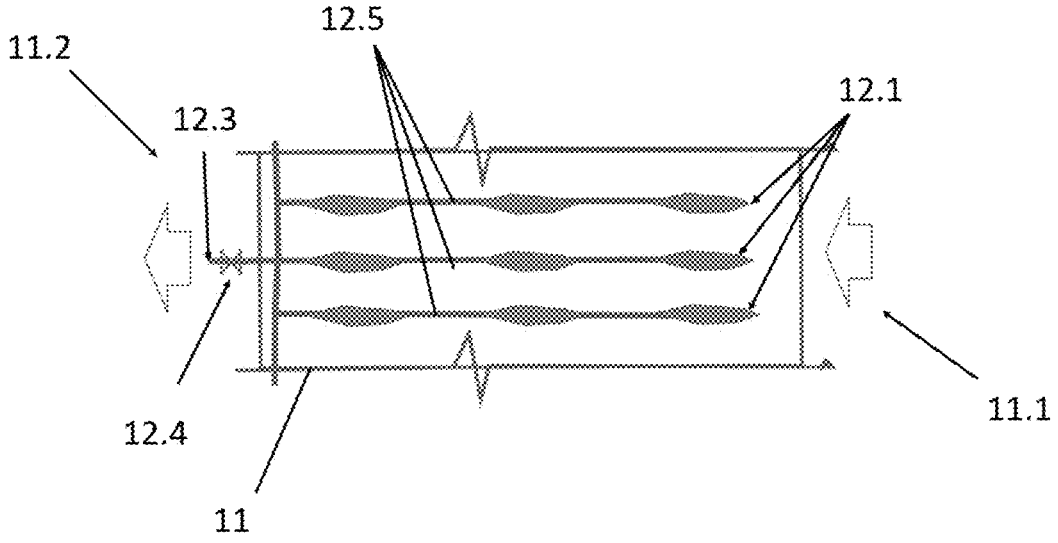
FIGS. 6*a* to 6*c* show schematic views of the embodiment shown in FIG. 5 intersected by different planes.

FIGS. 6*a* shows the view resulting from intersecting the embodiment shown in FIG. 5 with the plane AA. In particular, it provides a plan view that allows to appreciate details of the interior of a hollow chamber (11) according to the embodiment of FIG. 5. This hollow chamber (11) is configured for the flow of a first fluid. For the provision of said flow of first fluid, the hollow chamber (11) comprises a fluid inlet (11.1) configured to be in fluidic communication with a source of fluid, and a fluid outlet (11.2). Said flow of first fluid is schematically depicted with white unfilled arrows.

The first fluid can be cold or hot depending on the heat exchange mode of operation that is intended to be performed. In any case, as can be seen, the cross section of the enclosure roots (12.1) are provided with an aerodynamic profile geometry, more specifically a NACA profile with the leading edge oriented towards the inlet (11.1) of the hollow chamber (11) for diverting an incident flow of first fluid during an operative mode of the heat exchanger module (10).

According to this particular shape of the enclosure roots (12.1), pressure drop of the first fluid flowing through the hollow chamber (11) is reduced.

In addition, in the embodiment of FIG. 6*a*, details of the working fluid distribution circuit are shown, which is responsible for recharging or extracting the working fluid from inside the hollow enclosures, by means of a main pipe (12.3) that includes flow regulating means (12.4), which in the particular case shown is an air nipple valve, downstream of which the pipe (12.3) branches into a plurality of branches (12.5) in fluidic communication the hollow enclosures.

Figure 6B:
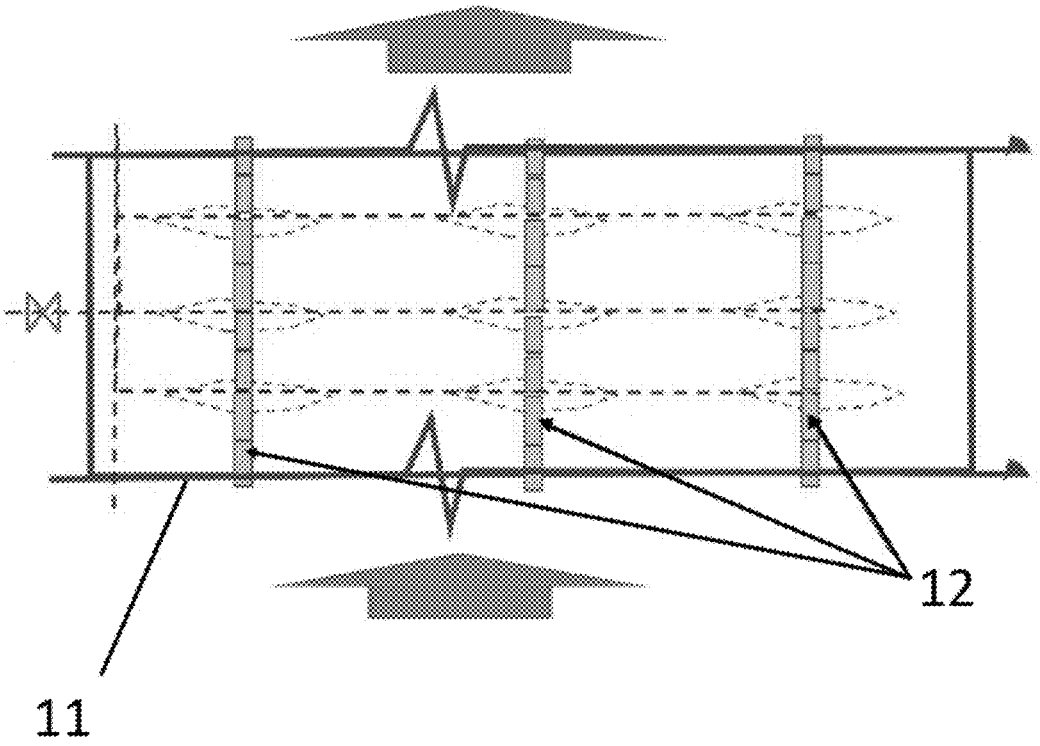

FIGS. 6*b* shows the view resulting from intersecting the embodiment shown in FIG. 5 with plane BB. In particular, it provides a plan view that allows to appreciate details of the relative disposition of the hollow enclosures (12) between them and in relation to the hollow chamber (11), as well as the direction of the second fluid provided to carry out the heat-exchanging operation.

In particular, said hollow enclosures (12) are arranged parallel to each other. With respect to the hollow chamber (11), as in the previous embodiments shown, the hollow enclosures (12) project perpendicularly from the uppermost surface of the hollow chamber (11).

Regarding the second fluid, the direction of advance is represented with grey arrows. As can be seen, said second fluid travels essentially parallel to the very own hollow enclosures (12) passing through the channels defined between consecutive hollow enclosures (12), bathing the lateral surfaces thereof, thus carrying out the heat-exchanging operation.

Figure 6C:
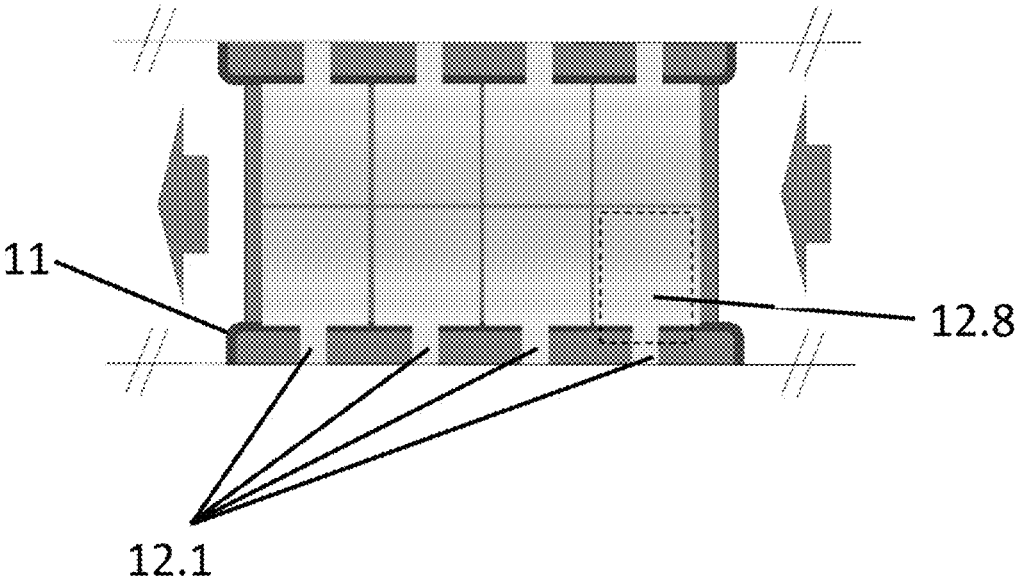

FIGS. 6*c* shows the view resulting from intersecting the embodiment shown in FIG. 5 with plane CC.

FIG. 6*c* allows to see details of how the second fluid travels parallel to the hollow enclosures through the channels defined between them, bathing their lateral surfaces. Likewise, FIG. 6*c* allows to see a plurality of compartments (12.8) into which the hollow enclosure (12) is divided, each of said compartments (12.8) comprising an enclosure root (12.1) inserted within the chamber (11), that is, extending into the inner volume of the hollow chamber (11) in order to establish contact with a first fluid flowing through the hollow chamber (11) during operation of the heat exchanger module.

Figure 7:
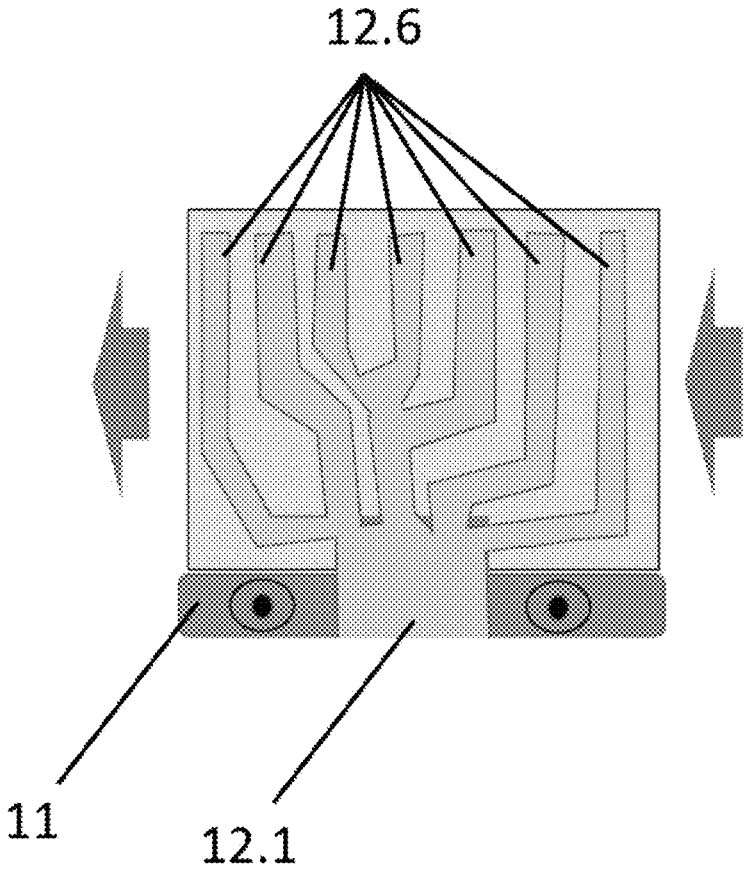
FIG. 7 shows a schematic representation of an enlarged view of a compartment of a hollow enclosure according to an embodiment of the invention.

FIG. 7 shows a schematic representation of an enlarged view of the area of FIG. 6*c* delimited with a square drawn with a dashed line, that is, of one of the compartments (12.8) into which the hollow enclosure is divided. In particular, FIG. 7 represents an embodiment of the geometry of the portion of the inner volume provided within a single compartment (12.8) of a hollow enclosure (12), and where the working fluid is contained.

As can be seen, said inner volume is shaped as a plurality of ducts (12.6) separated from each other, said ducts (12.6) branching from the enclosure root (12.1).

In one example of an operative mode of the embodiment shown in FIG. 7, the plurality of ducts (12.6) are filled with working fluid in vapor phase, because a hot fluid flowing through the hollow chamber heats a liquid phase of the working fluid contained in the enclosure root (12.1). A flow of cold gas, whose direction of advance is represented with white unfilled arrows, passes through the channels defined between consecutive hollow enclosures, bathing the lateral surfaces thereof.

Convection forced by the flow of cold gas evacuates part of the thermal energy. Therefore, the working fluid condenses back into a liquid phase and returns, by the action of the capillary forces caused by wick structures provided on the internal surfaces of the ducts (12.6), to the enclosure root (12.1), where the liquid working fluid is exposed again to the heat of the fluid flowing therethrough, the heat evacuating cycle being maintained thereby.

Figure 8:
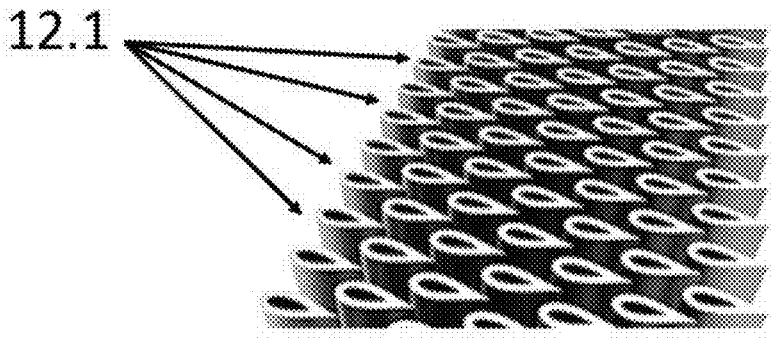
FIG. 8 shows a schematic representation of a plurality of enclosure roots provided with an aerodynamic profile geometry.

FIG. 8 shows a schematic representation of a plurality of enclosure roots (12.1), that is, the portion of the hollow enclosures inserted into a hollow chamber, provided with an aerodynamic profile geometry. Preferably, said enclosure roots (12.1) have a NACA airfoil geometry, arranged with the leading edge oriented towards the inlet of the hollow chamber for diverting an incident flow of fluid during an operative mode of the heat exchanger module.

Figure 9:
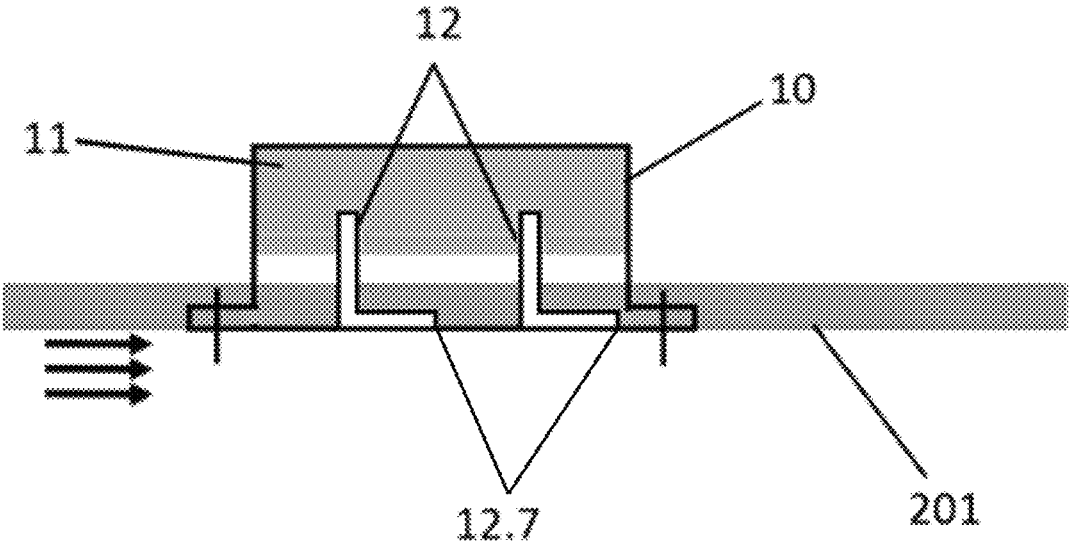
FIG. 9 shows a schematic representation of a heat exchanger module wherein the distal ends of two hollow enclosures are coupled to the outer fuselage skin of an aircraft according to an embodiment of the invention.

FIG. 9 shows a schematic representation of a heat exchange module wherein the distal ends (12.7), and a portion of the lateral surface of two hollow enclosures (12) are coupled to the outer fuselage skin (201) of an aircraft. As can be seen, the hollow enclosure (12) has an 'L' shape and, part of the portion inserted into the outer fuselage skin (201) of the fuselage is flush with the external limit of the outer fuselage skin (201) exposed to the outside airflow. Thus, said portion of the hollow enclosures (12) is likewise directly in contact with the outer airflow of the aircraft (200). In another embodiment, a portion of the hollow enclosures (12) inserted in the skin (201) of the aircraft (200) may protrude outwardly from the external skin (201), entering the outer airflow.

According to this embodiment, it is possible to transfer heat directly to the exterior of the aircraft through the connection between the hollow enclosures (12) and the skin (201) of the aircraft as well as directly by the part of the hollow enclosures (12) in contact with the external airflow.

More specifically, in the example shown, a hot fluid intended to be cooled circulates through the hollow chamber (11) of the heat exchanger module. Said fluid transmits part of its thermal energy to the working fluid contained within the hollow enclosures (12) through the outer surface of the portion of the hollow enclosures (12) inserted in the hollow chamber (11).

Accordingly, said portion of the hollow enclosures (12) bathed by the hot fluid flowing through the hollow chamber (11) represents the hot interface at which the working fluid contained within the hollow enclosures (12) absorbs energy enough to turn into the vapor phase.

This vapor phase of the working fluid expands inside the internal volume of the hollow enclosure (12), thus travelling to the cold interface of the heat exchanger module, that is, to the area near the distal end (12.7) coupled to the outer fuselage skin (201) of the aircraft.

Convection forced by the surrounding airflow evacuates part of the thermal energy. Therefore, the working fluid condenses back into a liquid phase and returns, by the action of the capillary forces caused by wick structures provided on the internal surfaces of the hollow enclosures (12), to the portion of the hollow enclosure (12) inserted in the hollow chamber (11), where the liquid working fluid is exposed again to the heat of the fluid flowing therethrough, the heat evacuating cycle being maintained thereby.

In an operative mode of the embodiment shown in FIG. 9, the surrounding air can be at −50° C. (degrees Celsius) at cruise conditions thus being an optimal heat sink for evacuating heat.

Alternative examples of different aircraft structures which could benefit from the configuration shown in the embodiment of FIG. 9, wherein an outer fuselage skin (201) is used as a heat transfer surface are the wing or empennages, with their different elements such as the leading edge, trailing edge, torsion box or movable surfaces.

Additionally, the engine and nacelle surfaces can be used as heat transfer surface or even the flow in contact with the nacelle can be used as second fluid, providing the hollow enclosures with the advantage that the free stream of air flowing, for example, outside of the fan cowl, has higher relative velocity than the one on the rest of the aircraft, thus providing additional capability to remove heat.

Figure 10:
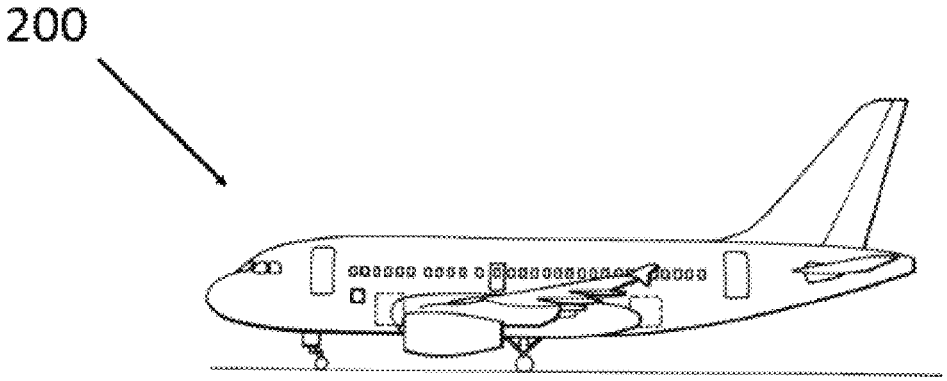
FIG. 10 shows an embodiment of an aircraft comprising a heat exchanger module according to the invention.

FIG. 10 shows an embodiment of an aircraft (200) comprising a heat exchanger module according to the invention.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. A heat exchanger module comprising:

a hollow chamber comprising an inner volume configured to contain a first fluid, said hollow chamber includes a first fluid inlet and a first fluid outlet, wherein the first fluid inlet is configured to be in fluidic communication with a source of a first fluid and the first fluid outlet is on a side of the hollow chamber opposite to the first fluid inlet, and hollow enclosures each extending outwardly from a surface of the hollow chamber, said hollow enclosures each include an inner volume containing a working fluid, wherein said working fluid is configured to undergo a phase change in the hollow enclosures during an operative mode of the heat exchanger module, wherein the hollow enclosures are spaced apart from each other and arranged substantially parallel to each other on the at least one hollow chamber, and channels between the hollow enclosures provide a flow path for a second fluid flowing through the channels and across outer surfaces of the hollow enclosures, wherein the hollow enclosures are configured to exchange heat energy between the working fluid and the second fluid flowing through the channels, wherein each of the hollow enclosures include a root that extends into the inner volume of the hollow chamber, wherein, during the operative mode, the first fluid flowing through the hollow chamber from the first fluid inlet to the first fluid outlet bathes an outer surface of the roots of the hollow enclosures.

2. The heat exchanger module according to claim 1, wherein the hollow enclosures each include a wick structure provided on at least a portion of an inner surface of the hollow enclosure, and the wick structure includes at least one of: sintered metal powder, a screen mesh, a screen-covered groove, a grooved screen slab, or a grooved screen tunnel.

3. The heat exchanger module according to claim 1, further comprising fins in the channels and the fins extend between the hollow enclosures.

4. The heat exchanger module according to claim 3, wherein the fins have an undulating profile shape.

5. The heat exchanger module according to claim 1, wherein each of the enclosure roots has an aerodynamic profile including a leading edge oriented towards the first fluid inlet of the hollow chamber, and each of the enclosure roots is configured to divert an incident flow through the hollow chamber attached to the root, wherein the incident flow is of the first fluid during the operative mode of the heat exchanger module.

6. The heat exchanger module according to claim 1, further comprising a working fluid distribution circuit comprising:

a fluid distribution circuit inlet configured to be in fluidic communication with a source of the working fluid external to the hollow enclosures after the working fluid flows through the hollow enclosures, branches, and a conduit connected to the fluid distribution circuit inlet, wherein the conduit includes branches each connected an inlet to of a respective one or more of the hollow enclosures.

7. The heat exchanger module according to claim 1, wherein the inner volume of each of the hollow enclosures includes compartments each configured to form a flow passage for the second fluid to flow through the hollow enclosure, wherein the compartments are in fluid communication with the enclosure root of the hollow enclosure.

8. The heat exchanger module according to claim 1, wherein the inner volume within each of the hollow enclosures includes ducts separated from each other, and the ducts branch from the root for the hollow enclosure.

9. A method for manufacturing a heat exchanger module of claim 1, using an additive manufacturing technique, the method comprising:

providing a bed of powdered material;

forming a plurality of layers by fusing together at least a portion of the powdered material to form the hollow enclosure comprising the inner volume and a hollow chamber; and confining the working fluid within the inner volume of each of the hollow enclosures during the manufacturing process, layer by layer, of said hollow enclosure, such that the working fluid is contained within the inner volume after the hollow enclosure is formed by the forming of the plurality of layers.

10. The method for manufacturing a heat exchanger according to claim 9, wherein:

the forming a plurality of layers includes forming a working fluid distribution circuit in the hollow chamber, wherein the working fluid distribution circuit includes a plurality of branches each configured to be connected to a pipe; and/or the hollow enclosures are made integrally with a plurality of ducts each formed with a wick structure on at least a portion of a surface of the ducts.

11. A heat exchanger comprising:

the heat exchanger module of claim 1, which is a first heat exchanger module and the roots are a first system of roots, and, a second heat exchanger module including a second system of roots, wherein the first heat exchanger module is coupled to the second heat exchanger module at distal ends of the first system of roots and the second system of roots.

12. The heat exchanger module according to claim 1, wherein the heat exchanger module is configured to be mounted in an aircraft and at least a distal end of at least one of the hollow enclosures is configured to be coupled to an outer skin of the aircraft.

13. The heat exchanger module according to claim 12, wherein the portion of the outer skin is part of one of: a wing; an empennage; or a nacelle.

14. The heat exchanger module according to claim 12, wherein the heat exchanger module is configured to be in fluidic communication with a source of air bled from a bypass stream flowing through from an engine fan duct of the aircraft.

15. A heat exchanger module comprising:

a hollow chamber including an inner volume forming a flow passage for a first fluid and having a first surface;

hollow enclosures each extending outwardly from the first surface and having a root extending through the first surface into the inner volume, wherein each of the hollow enclosures contains a working fluid which undergoes a phase change in the hollow enclosures during an operative mode of the heat exchanger module, and the working fluid is in thermal communication with the first fluid through the root of each of the hollow enclosures, and channels defined by gaps between the hollow enclosures, wherein the channels form flow passages for a second fluid in thermal communication with the working fluid, wherein the flow passage extends from a first fluid inlet on an first side of the hollow chamber to a first fluid outlet on a second side of the hollow chamber opposite to the first side.

16. The heat exchanger module of claim 15, wherein the hollow enclosures have a hollow airfoil shape in cross section, and a leading edge of the airfoil shape faces a flow of the first fluid passing through the follow passage in the hollow chamber, and the hollow air foil shape includes an inner duct receiving the working fluid.

17. The heat exchanger module of claim 15, further comprising fins extending between adjacent ones of the hollow enclosures.

18. The heat exchanger module of claim 15, wherein the heat exchanger module is a first heat exchanger module and the hollow enclosures of the first heat exchanger module each include a first distal edge opposite the root of the hollow enclosure, wherein the first distal edge of each of the hollow enclosures is configured to connect to a second distal edge of hollow enclosures of a second heat exchanger module.

19. The heat exchanger module of claim 18, wherein the connection between the first distal edges and the second distal edges forms a passage for working fluid to flow between the hollow enclosures of the first heat exchanger module and the hollow enclosures of the second heat exchanger module.

20. A heat exchanger module for an aircraft, the heat exchanger module comprising:

a hollow chamber including an inner volume forming a flow passage for a first fluid and having a first surface;

hollow enclosures each extending outwardly from the first surface and having a root extending through the first surface into the inner volume, wherein each of the hollow enclosures contains a working fluid which undergoes a phase change in the hollow enclosures during an operative mode of the heat exchanger module, and the working fluid is in thermal communication with the first fluid through the root of each of the hollow enclosures, and channels defined by gaps between the hollow enclosures, wherein the channels form flow passages for a second fluid in thermal communication with the working fluid, wherein at least one of the hollow enclosures is configured to be coupled to an outer skin of the aircraft.

* * * * *